United States Patent [19]

Ludscheidt

[11] 4,389,923

[45] Jun. 28, 1983

[54] EXHAUST APPARATUS FOR REMOVING POLLUTANTS

[76] Inventor: Horst Ludscheidt, Westfälische Str. 171, 4600 Dortmund, Fed. Rep. of Germany

[21] Appl. No.: 254,768

[22] Filed: Apr. 16, 1981

[30] Foreign Application Priority Data

| | | | |
|---|---|---|---|
| Apr. 19, 1980 | [DE] | Fed. Rep. of Germany | 3015129 |
| Sep. 17, 1980 | [DE] | Fed. Rep. of Germany | 3035052 |
| Nov. 3, 1980 | [DE] | Fed. Rep. of Germany | 3041350 |

[51] Int. Cl.[3] ..... F23J 15/00

[52] U.S. Cl. ..... 98/115 VM

[58] Field of Search ..... 98/115 VM, 115 R; 49/409, 412

[56] References Cited

U.S. PATENT DOCUMENTS

| | | | |
|---|---|---|---|
| 3,478,668 | 11/1969 | Scheel | 98/115 |
| 3,481,265 | 12/1969 | Scheel | 98/115 VM |
| 3,705,545 | 12/1972 | Overmyer et al. | 98/115 VM |
| 3,913,470 | 10/1975 | Cullen | 98/115 VM |
| 3,955,984 | 5/1976 | Hirahama et al. | 98/115 VM |
| 4,086,847 | 5/1978 | Overmyer | 98/115 VM |
| 4,173,176 | 11/1979 | Svensson | 98/115 VM |

FOREIGN PATENT DOCUMENTS

| | | |
|---|---|---|
| 1924266 | 5/1969 | Fed. Rep. of Germany . |
| 2137196 | 12/1972 | France . |
| 1408099 | 10/1975 | United Kingdom . |
| 1516931 | 7/1978 | United Kingdom . |

*Primary Examiner*—William E. Tapolcai

*Attorney, Agent, or Firm*—Toren, McGeady and Stanger

[57] ABSTRACT

Apparatus for removing pollutants, particularly automotive exhaust gases, from work areas or the like is formed with an elongate stationary duct for exhausting pollutants therethrough and with a bearing bracket longitudinally movable along the stationary duct for connecting an exhaust hose to the duct adapted to receive pollutants. By movement of the bearing bracket along the duct, the exhaust hose may be moved to any one of a number of desired locations. The stationary duct is formed with displaceable sealing elements which are moved by the bearing bracket between a sealing position and a position allowing the hose to be placed in flow communication with the stationary duct as the bearing bracket is moved along the duct. Alternatively, the exhaust hose may be connected with a second elongate duct which is itself movably connected with the stationary duct through displaceable sealing elements.

26 Claims, 7 Drawing Figures

EXHAUST APPARATUS FOR REMOVING POLLUTANTS

The present invention relates generally to apparatus for controlling the environment in commercial work areas and, more particularly, to an arrangement for exhausting solid, liquid, or gaseous pollutants, especially exhaust gases from an internal combustion engine, from a work area such as a garage or automotive repair facility.

The invention is particularly directed to the type of apparatus wherein a longitudinal stationary duct is provided with an exhaust hose attached thereto by means of a bearing bracket wherein the bearing bracket may engage with areas in the stationary exhaust duct through a suction slot provided with sealing elements, and wherein the sealing elements may be moved by the bearing bracket from a position sealing the suction slot to a position releasing the suction slot and vice versa.

Known devices of the type to which the present invention relates are generally used in vehicle workshops or vehicle depots and consist of suction ducts installed in the region of the ceiling of the workshop and connected with an exhaust ventilator. The suction ducts include a track on their interior at which the suction carts or bearing brackets are movably arranged. The underside of the suction ducts, which permits passage of the suction carts, is constructed as a suction slot sealed by sealing lips such as packing washers located at an angle relative to each other, wherein during movement of the suction carts, the sealing lips are moved apart and are again joined closely together after the suction cart has passed therethrough.

Such arrangements are especially disadvantageous due to the fact that after long use, the sealing lips, which are made of a rubber-like material, will lose their sealing effect because of fatigue. As a result, the exhaust ventilator will draw in more and more outside air and the unit will become ineffective.

Additionally, the sealing lips are usually only heat resistant to a very limited extent and therefore the units are not suitable for high performance test stands or similar equipment. Known units also have the disadvantage that, if the hose carts are arranged with insufficient space between each other, the sealing lips will no longer completely close so that even with intact sealing lips, a high volume of outside air will be drawn in.

The present invention is directed toward the provision of a solution with which a unit may be created by economical means which will be especially suitable for use in dealing with harmful substances having high temperatures where the sealing means of the suction duct will not be subjected to excessive wear and wherein it will be possible for the hose carts to follow each other in close succession.

SUMMARY OF THE INVENTION

Briefly, the present invention may be defined as apparatus for removing pollutants, particularly automotive exhaust gases, from work areas or the like comprising elongate stationary duct means for exhausting pollutants therethrough, exhaust hose means adapted to receive pollutants operatively connected with said duct means, bearing bracket means longitudinally movable along said duct means connecting said exhaust hose means with said duct means, and displaceable sealing means on said duct means adapted to be moved by said bearing bracket means between a position sealing said duct means and a position allowing said hose means to be placed in flow communication with said duct means as said bearing bracket means is moved along said duct means.

In accordance with the present invention, the displaceable sealing means comprise sealing elements which are constructed as link elements of heatproof material. These links are connected to each other and are movable relative to each other and they are preferably slideable in the longitudinal direction or transverse to the direction of movement of the bracket means, with the link elements being guided at the suction duct.

With the link elements according to the invention, very effective sealing of the suction duct is possible in a simple manner wherein simultaneously the opening and closing of the suction slot necessitated by the bearing bracket means can be undertaken in an especially easy and effective manner.

In order to prevent problems which may arise from the use of sealing lips, the invention provides a sealing effect by means of the link elements connected with each other which, depending upon their construction, can be manufactured of suitable material, and which need not have only a mere sealing function, but which may also guarantee the mobility of the entire seal.

In an embodiment in accordance with the invention, it is provided that the link elements are connected with each other so that they can slide in the longitudinal direction wherein it can be provided in another embodiment that a longitudinal end face of the link element is constructed to engage behind the corresponding end face region of the adjoining element. This embodiment makes it possible to cover the suction slot in such a way that it is practically totally prevented from receiving any flow of outside air.

It has proven to be practical for the link elements to be provided each with a roller which may be acted upon by a coulisse surface at the bearing bracket or hose cart, wherein the hose cart is preferably equipped with a guide track for the positive guidance of the rollers at the link elements.

With this embodiment, preferred in accordance with the present invention, i.e., with a control portion at each link element which makes lifting and lowering possible and with a positive guiding function for the control portions at each hose cart, false actuation of the elements is precluded. Moreover, movement of the hose carts or bearing brackets will be especially facilitated when the control portions are constructed as rollers which are positively guided in a control template at the inside of the hose cart of the suction duct.

It is particularly practical if, as is also provided in accordance with an embodiment of the invention, fixation of the link elements at the suction duct involves at least one link element equipped with a guidance. This guidance can be constructed, for instance, as a guide rod engaging into the hollow space of the profiled link element, as is described hereinafter.

Basically, it is possible to arrange the suction slot at any side of the suction duct, for instance at the underside thereof, and to form the sealing elements with two chains of link elements which are moved if appropriate against the spring tension of the hose carts. However, the invention intends to provide an embodiment where the suction slot is arranged at a lateral, essentially vertical wall of the suction duct. This embodiment has the advantage that only one chain of link elements is needed for sealing of the suction duct. The suction cart moves under the chain and lifts the links against the direction of the force of gravity.

Since the series of curves, resulting from lifting of the link elements, usually has a slightly larger bending radius than that of the suction nozzle which effects this movement, openings will result between the suction nozzle and the lower edge of the adjoining link elements through which basically outside air could be drawn in. Therefore, the invention provides that the hose cart or bearing bracket is provided with a sealing disc which can be moved parallel to the suction slot and which covers the opening resulting from the lifting of the link elements wherein the suction nozzle is guided through this sealing disc. Consequently, the sealing disc prevents outside air from flowing in so that the full suction efficiency of the system will be ensured independent of the position of the hose carts.

In accordance with the invention, it may also be provided that the guide profiles for the link elements and the tracks for the hose carts assigned to these elements may be constructed by one upper and one lower profile attached at the suction duct and preferably made of light metal wherein the hose carts are preferably guided on an endless track through the intermediary of the suction duct provided with inlet and outlet sluices.

A further goal of the invention is the creation of a solution wherein a hose cart can be moved independently of the curvature of the track, the slope of the track or the distance of the track, and independently of adjoining hose carts insofar as free mobility is possible.

The invention therefore contemplates that the hose carts be guided at another guide track together with the drive unit and that they are permanently connected with the drive unit in a positive locking manner.

As a result of this capability, each hose cart may be provided with its own drive in such a way that, in addition to being controlled separately and being capable of movement in both directions along a guide track, it is also independent of the radii of curvature of the guide tracks, i.e., extremely small radii of curvature can be driven with the unit according to the invention which leads to a very compact construction of the entire system equipped with this unit. Additionally, it is a special advantage that known systems of conventional construction can be equipped subsequently with a device in accordance with the invention without requiring complicated modifications of the individual hose carts.

The invention provides, in an embodiment thereof, that the driving device be equipped with a driving motor and with an undercarriage, movable in another guide track and carrying a friction drive, wherein it may also be provided that the undercarriage is connected with a hose cart by means of a joint element having a joint axis aligned essentially perpendicularly.

It has been shown that in order to balance especially narrow radii of curvature, it is advantageous to have the undercarriage of the drive and the hose cart with the rollers supported in another guide track whose suspension is constructed to be rotatable with respect to the undercarriage and the hose cart.

In fields other than those related to the present invention, drives movable in tracks which pull other parts of a unit are already known. For example, known apparatus exists having an electromotor friction drive for a supply cable to be pulled. In drives of this type, the friction wheel will run in the interior of a support track constructed as a hollow track with an essentially C-shaped configuration. In structures of this type, disadvantages arise in that total symmetry of construction of all parts of the system is necessary in order to prevent tilting of rollers. Also, a friction wheel running inside requires very large radii of curvature of the track.

However, in the present invention, it is provided that the driving device be formed with a horizontally aligned electric motor and a friction drive running on another guide track wherein, in a special embodiment, it can be provided that the friction wheel to balance out a radius of curvature of another side track has a greater width than the effective area of another guide track in contact with the friction wheel.

These measures in accordance with the invention have the advantage that very small radii of curvature of the guide track are possible.

For the transfer of large frictional forces from the driving motor via the friction wheel to the guide track, it is also provided in accordance with the invention that the profile of the friction wheel at its contact surface be equipped with a center apex arranged approximately symmetrically, a radius of curvature or similar in such a way that the friction wheel can engage with an area that projects slightly from the profile into the motion slot of the guide track.

For exact dosing of the frictional force of the friction wheel at the track, it is provided in accordance with the invention that the rollers of the driving unit be adjustable in their distance from the undercarriage so that, due to change of the distance between the rollers and the undercarriage relative to the guide track, the friction wheel which is stationary with respect to the undercarriage can be stressed against the track.

Another essential feature of the invention consists in that the working planes of the joint, connecting the hose cart and the driving device in positive locking manner be arranged offset in steps with the mass centers of the hose cart on the one hand and the driving device on the other hand being arranged always on different sides of the guide track. Due to these measures, the entire system is balanced with regard to weight to that it can move without special guide elements from the other guide track directly to the tracks at the suction duct with additional guide rollers.

In accordance with a further embodiment of the invention, the stationary duct means may have connected thereto elongate movable duct means with the exhaust hose means being connected through the bearing bracket means and through the displaceable sealing means with the elongate movable duct means. The movable duct means are connected with the stationary duct means by similar bearing bracket means and sealing link elements so that the movable duct means, with the exhaust hose means movably connected thereto, may be, in turn, longitudinally moved in flow communication along said stationary duct means.

In this embodiment of the invention, features of particular advantage arise in that greater mobility of the exhaust hose means results in that all points in a workshop or similar area may be reached with the apparatus. Furthermore, each location where the apparatus may be used can be better controlled and free mobility is provided first in an x/y plane and ultimately in an x/y/z space. This embodiment of the invention has the advantage that, due to the assignment of a stationary suction duct and the effective connection of the movable suction duct with the hose carts of the exhaust hose means, in turn movable at the suction duct, large surfaces can be covered wherein the entire system is especially suitable for automated control.

In accordance with some of the more detailed features of this embodiment of the invention, the stationary and the movable suction ducts may be constructed in an identical form thereby making prefabrication during manufacturing possible, which will provide an especially economical structural arrangement. The hose carts of the movable duct may be connected with the movable duct by means of a flexible hose. It is advantageous to attach the movable suction duct with the stationary suction duct at a longitudinal end of the movable suction duct, which end may have a suction cart rigidly attached thereto.

In order to effect automated control of this embodiment, it is considered especially practical to provide suction carts and/or the additional suction duct and/or the hose carts with their own drive means wherein the drive means may, for instance, be comprised of double-acting pneumatic cylinders without piston rods or other driving means for example endless chains, spindles, electromotive drives or the like. The assignment of effective suction openings at the hose carts for each point in the space can be realized either by lifting and lowering of the suction openings at the hose of the hose carts or by providing a third suction duct.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive material in which there are illustrated and described preferred embodiments of the invention.

DETAILED DESCRIPTION OF THE PREFERRED EMBODIMENTS

Figure 1:
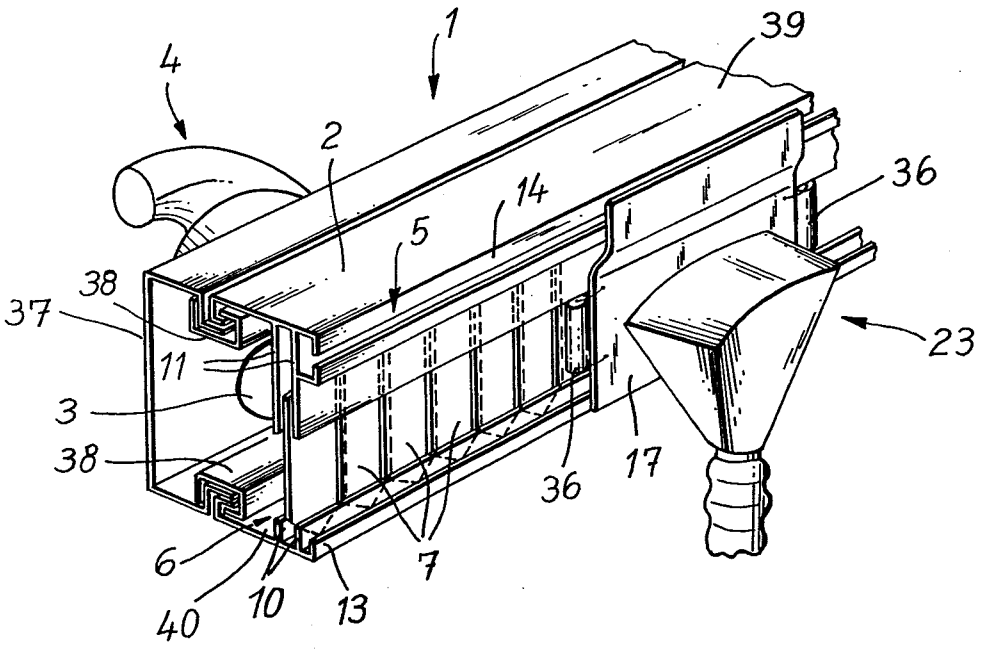
FIG. 1 is a perspective view of a portion of the exhaust apparatus in accordance with the present invention showing the suction duct with the hose carts arranged thereon to be movable relative thereto.

Referring now to the drawings, wherein similar reference numerals are used to designate like elements throughout the various figures thereof, apparatus for the exhaust and removal of harmful substances is shown and identified in its entirety by reference numeral 1. The apparatus consists essentially of an elongate stationary suction duct 2 having an essentially rectangular cross section which is installed, for example, in the region of the ceiling of a workshop or automobile repair shop. The suction duct 2 is connected by means of a suction opening 3 with an exhaust ventilator 4.

Figure 3:
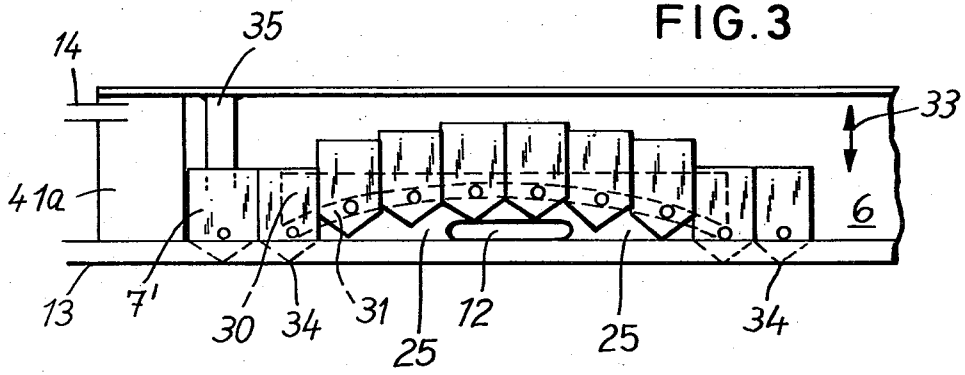
FIG. 3 is a side view of the link elements shown schematically as they are being lifted by the hose cart or bracket means.
Figure 5:
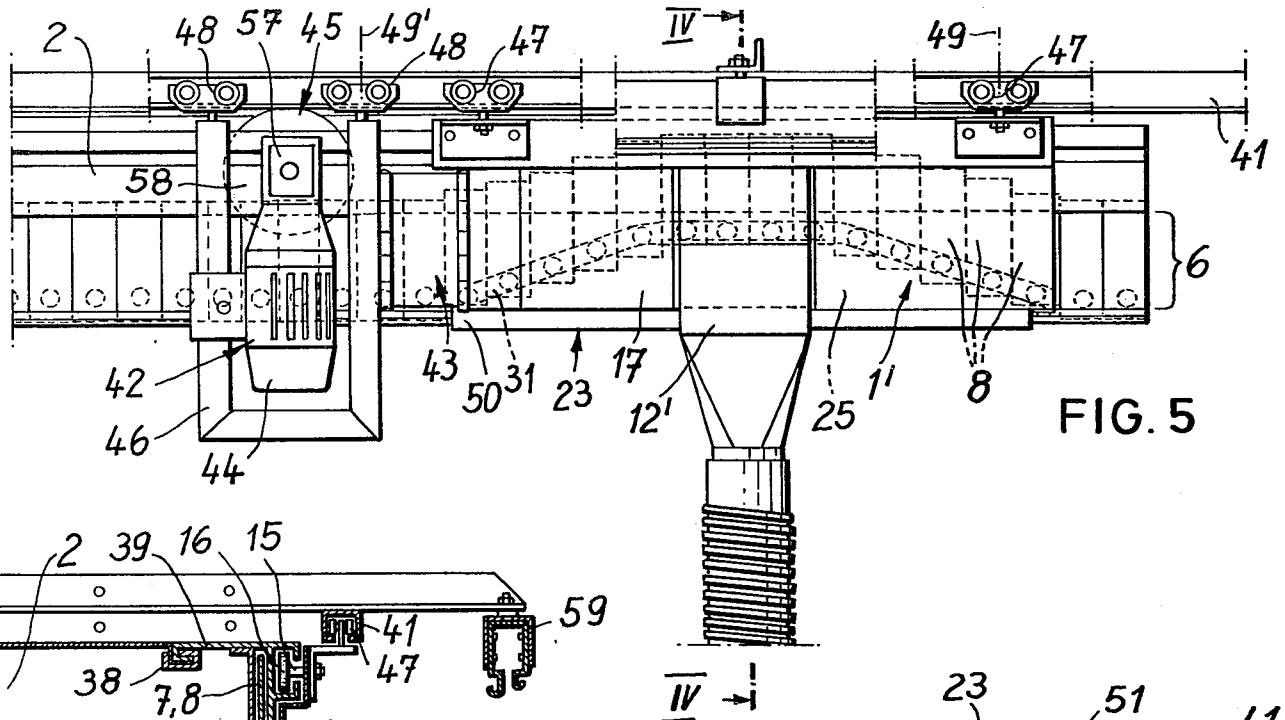
FIG. 5 is a lateral view of an arrangement in accordance with the invention shown with a driving unit.

The suction duct 2 is equipped with a vertical wall 5 having a suction slot 6 which is closed by a plurality of essentially beaver-tail shaped link elements 7 (see FIG. 3) or rectangularly shaped link elements 8 (see FIG. 5).

The link elements 7, 8 are alternately arranged in overlapping relationship and the link elements may be made of plates of metal or asbestos cement or other heatproof materials.

Figure 4:
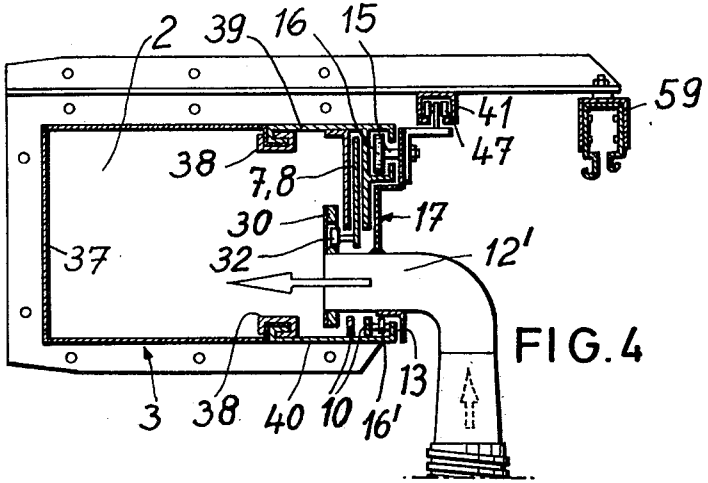
FIG. 4 is a sectional view taken along the line IV—IV in FIG. 5.

In order to provide guidance for the link elements 7, 8, the vertically extending lateral wall 5 is profiled in a manner depicted in FIGS. 1 and 4. At its bottom part there are formed two short guide bars 10, while in the top region thereof, two long guide bars 11 are provided within which the link elements, as shown especially in FIGS. 3 and 5, can be lifted up to a distance so that below them a suction nozzle 12 or 12' may be moved, as will be further described hereinafter.

In addition to the short guide bars 10, an outwardly and upwardly directed track 13 is formed in one piece in the lower region, with an outwardly and downwardly directed track 14 being formed in the upper region of the wall 5. Rollers 16, 16' arranged in bearing blocks 15 run on the tracks 13 and 14 (FIG. 4). The bearing blocks 15 are fastened to a sealing disc 17 which is slideable in the plane of the vertical wall 5 by means of rollers 16 wherein the suction nozzle 12, 12' is guided through the sealing disc into the interior of the suction duct 2, as is evident from FIG. 4.

Figure 2:
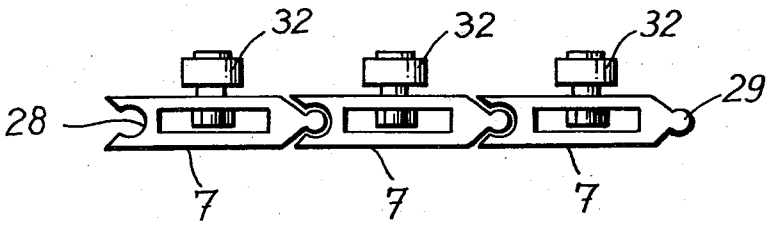
FIG. 2 is a top view of the link element of the invention shown on an enlarged scale.

As will be seen especially from FIG. 2, the link elements 7 are connected with each other so as to be slideable in the direction of their longitudinal dimension, with the link elements alternately engaging on opposite sides thereof by means of a dovetail-shaped longitudinal slot 28 and on the other side by means of a longitudinal projection 29 engaging in the longitudinal slot. The link elements are made of metal, asbestos cement, or any other heatproof material. The embodiment illustrated relates to hollow aluminum profiles. As can be seen especially in FIG. 2, each link element 7 is provided with a roller 32, if appropriate, running in ball bearings which are directed to the interior of the duct 2. When the hose cart 23 and consequently the guide disc 30 are moved in the interior of the duct, then the rollers 32 engage one after the other with the guide track 31 and effect lifting and lowering of the laterally guided link elements 7, 8 in the direction of the double arrow 33 seen in FIG. 3. The link elements 7 are formed with an angular configuration at the lower ends thereof so that a point contact region 34 is provided.

The link element 7' (FIG. 3) is held at the suction duct by means of guide rod 35 in such a way that it can move in the direction of the double arrow 33. However, movement in the driving direction of the hose cart 23 is prevented.

As an additional seal to prevent outside air from entering the duct 2, there is provided in the embodiment shown at the sealing disc 17 sealing rollers 36 whose width corresponds to the width of the suction slot 6.

In FIGS. 1 and 4, there is depicted an arrangement wherein the entire duct 3 is constructed from individual sections wherein the rear wall section 37, which can be adjusted as to size to specific requirements and may, if appropriate, be made of aluminum sheets, is arranged so it can be fixed by means of clamping sections 38 at the track sections 39 or 40 which are of the same construction in all embodiments.

The suction duct can be equipped with inlet and outlet sluices 41a which make it possible to utilize an endless movement of several hose carts, which is not shown in detail.

Figure 6:
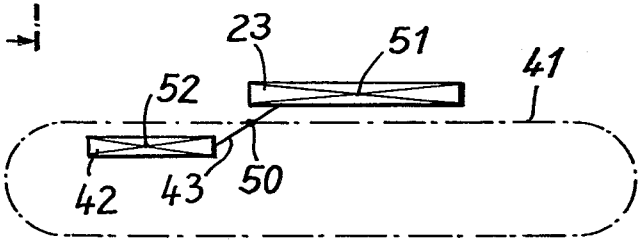
FIG. 6 is a simplified schematic view showing the system in accordance with the embodiment of FIG. 5.

In the modified embodiment according to FIGS. 5 and 6, the hose cart 23 is connected in a positive locking manner by means of a joint element 43 with a driving device 42.

The hose cart 23 is, in addition, movably arranged in another guide track 41 by means of rollers 47, and the driving device 42 is also equipped with rollers 48 running in the same guide track 41. The rollers 47 and 48 are mounted to be pivotal about vertical axes 49 and 49', as seen in FIG. 5, at the respective parts of the devices.

The joint element 43 is arranged in such a way that its swivel axis 50 is also essentially vertically aligned. As will be seen from FIG. 5 and in connection with FIG. 6, the joint element 43 is arranged relative to the guide track 41 at the hose cart 23 and the driving device 42 in such a way that the centers of gravity of the two device elements 23 and 42, identified in FIG. 6 with reference numerals 51 and 52, are arranged each on one side of the guide track 41.

The driving device 42 consists essentially of an undercarriage 46, an electric motor 44 arranged at the undercarriage, a gearing 57 and a friction wheel 58. The rollers 48 at the undercarriage 46 of the driving device 42 can be changed with regard to their spacing in such a manner that the friction wheel 58 may be stretched against the under side of the guide track 41 so that contact pressure can be varied. The electric motor 44 is supplied with energy over another contact rail 59, indicated in FIG. 4, but not described in greater detail.

Of course, the embodiments described may be changed in various ways without departing from the basic concepts of the invention. The invention is especially not limited to the selected suspension of the hose cart and the driving device, and it is also not limited to the specific forms of the link elements shown. In addition to the shown vertical position of the suction slot, a horizontal arrangement can also be used for the sealing of the suction duct, for example, with two rows of spring loaded sealing elements. This variation makes it possible to also install the suction duct in the floor area of a workspace.

The invention is also not limited to the dovetail projection 28, 29 of the individual elements 7, 8. It will be apparent that other types of connection may be utilized which will guarantee longitudinal guidance of the link elements.

Additionally, the driving device 42 shown in FIG. 5 may also be installed, for example, in a piggyback arrangement on the suction nozzle 12' wherein a suspension may be selected in such a manner that it may be moved vertically to the conveying direction for radius compensation when extending through a curve, or a friction roller can be used in place of the friction wheel. For compensation during movement through a curve, the undercarriage 46 can be equipped with a double joint.

Figure 7:
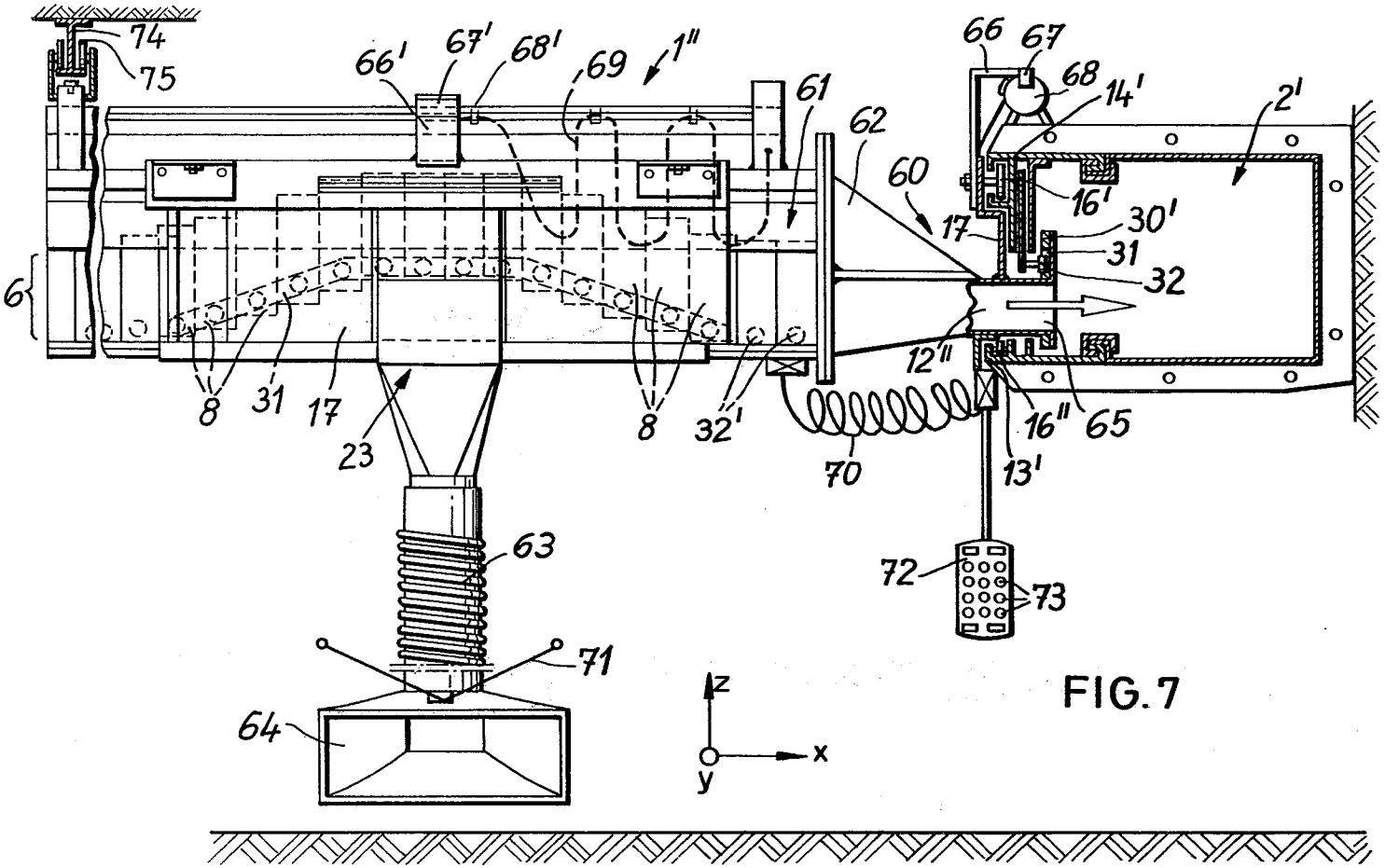
FIG. 7 is a simplified lateral view of apparatus in accordance with a further embodiment of the invention which is shown partly in section.

A further embodiment of the invention is depicted in FIG. 7. The exhaust apparatus shown in FIG. 7 is identified in its entirety by the reference numeral 1'' and is formed in the example illustrated with a stationary elongate suction duct 2' which has operatively connected therewith a suction cart 60. The suction cart 60 is arranged to be movable in the longitudinal direction of the stationary duct 2' and another movable elongate suction duct 61 is joined with the stationary duct 2' by means of the suction cart 60 which is joined with the movable duct 61 through a suction nozzle 62. As a result, the entire movable duct 61 may move along the longitudinal direction of the stationary duct 2' in a direction perpendicular to the plane of the drawing of FIG. 7.

The suction ducts 2' and 61 are formed essentially with the same construction. However, they may of course have different dimensions, particularly with regard to their effective cross-sectional areas. The dimensions will depend upon expediency and the required suction capacity. In view of this, only one suction duct is described, the description being intended to apply to both ducts. Additionally, the function and construction of the suction cart 60 and of the hose cart 23, which is connected with the movable duct 61, are basically the same and in one case a suction nozzle 62 which is flanged at the end face of the suction duct 61 is attached at the suction cart 60 and in the other case a suction cart 63 with an open suction funnel 64 is attached at the hose cart 23.

In FIG. 7, the suction cart and the hose cart are shown only schematically in a simplified form. The carts are guided to be movable at the suction duct in guide tracks 13' and 14' with rollers 16' and 16'' which are arranged at a sealing plate 17. The suction nozzle 12'' is guided with a region 65 into the interior of the suction duct and this region carries a coulisse disc 30' which is equipped with a coulisse track 31' whose function was previously described in detail. In the example illustrated, an arm 66 is welded to the sealing plate 17 and the arm is connected with a driving element 67 of a double-acting hydraulic cylinder 68 so that when the driving means 67 is moved, the suction cart or the hose cart is also moved because the hydraulic cylinder 68 is stationarily connected at the suction duct.

Control circuits parallel to the hydraulic cylinder 68 for the attachment of solenoid-operated switches or similar devices to control the positions of each element are not further shown in FIG. 7. The electrical connections, for instance connections made through cables 69 and 70, are only indicated schematically in FIG. 7, this applying also to sensor switches 71 at the suction funnel 64 which stop the movement of the exhaust apparatus when, for example, an obstacle is encountered. A control panel 72 with, for example, a plurality of positions which may be approached by means of switches 73 is also indicated only schematically in FIG. 7.

The movable suction duct 61 is guided at the end opposite the end thereof connected to the suction cart 60 in a stationary track 74 by means of rollers 75. Driving means may also be provided, for example, in this area, which driving means are not further described. In addition to the suspended construction, the free end of the suction duct 61 may also be guided, for example, by means of sliding elements so as to rest upon a sliding track or the like.

In the operation of the apparatus depicted in FIG. 7, during use of the mechanism in, for example, a brake test stand or efficiency test stand of a specific automotive installation, it is possible because of the types of automobiles in the program, based upon specific exact positions of the rear axle on a roller test stand, to determine exactly in advance the position of each individual exhaust of the different types of vehicles with respect to this roller stand and to feed them to an electric circuit. When driving the vehicle to the roller test stand, a driver may actuate the control panel 72 through the window of the vehicle in accordance with the type of vehicle involved and the suction funnel 64 will be moved by means of an appropriate circuit from a parking position automatically to the exhaust of the vehicle.

If the incorrect type of vehicle is erroneously programmed, then a sensor switch 71 will prevent further movement of the exhaust apparatus 1" if, for example, the vehicle which is actually on the test stand is much longer than the vehicle programmed. The apparatus may then, for example, be moved back into the parking position and subsequently into the correct position. The same circuit may also respond to height (z-axis) which, however, is not shown in FIG. 7.

The apparatus may also be arranged, for example, on the arms of automatic welding machines carrying welding electrodes and it can move with these arms in accordance with the control provided so that harmful substances resulting during welding or cutting may be drawn in directly at the place where they originate because the suction ducts will also be suitable for high temperatures.

Of course, the embodiment described may also be modified in several aspects without neglecting the basic concept of the invention. The invention is especially not limited to a specific type of drive of the individual elements and it is also not limited to the preferred installation in one plane. For example, the apparatus can be equipped to first sweep over a vertical wall of the shop if this should be feasible, depending upon the machine tools or the sources of harmful substances which may be encountered.

While specific embodiments of the invention have been shown and described in detail to illustrate the application of the inventive principles, it will be understood that the invention may be embodied otherwise without departing from such principles.

What is claimed is:

1. Apparatus for removing pollutants, particularly automotive exhaust gases, from work areas or the like comprising elongate duct means for exhausting pollutants therethrough, exhaust hose means adapted to receive pollutants operatively connected with said duct means, bearing bracket means longitudinally movable along said duct means connecting said exhaust hose means with said duct means, and displaceable sealing means on said duct means adapted to be moved by said bearing bracket means between a position sealing said duct means and a position allowing said hose means to be placed in flow communication with said duct means as said bearing bracket means is moved along said duct means, said sealing means comprising sealing elements constructed in the form of link elements connected with each other and movable relative to each other.

2. Apparatus according to claim 1 wherein said link elements are movable in a direction transverse to the direction of movement of said bearing bracket means along said duct means.

3. Apparatus according to claim 1 wherein said link elements are made of heatproof material.

4. Apparatus according to claim 1 wherein said duct means include guide means for guiding movement of said link elements.

5. Apparatus according to claim 1 wherein each of said link elements is constructed with adjacent sides adapted to engage with an adjacent side of an adjoining link element.

6. Apparatus according to claim 1 wherein said link elements are each equipped with a roller and wherein said bracket means includes a coulisse area, said roller being adapted to be acted upon by said coulisse area, said bracket means being preferably equipped with a guide track for the forceable guidance of said rollers of said link elements.

7. Apparatus according to claim 1 wherein at least one of said link elements is equipped with a guidance in order to effect affixation of said link elements at said duct means.

8. Apparatus according to claim 1 wherein said duct means includes a suction slot through which said hose means is placed in fluid flow engagement with said duct means, said suction slot being arranged in a laterally and essentially vertical wall of said duct means.

9. Apparatus according to claim 8 wherein said bracket means is provided with a sealing disc which can be moved parallel to said suction slot and which covers openings which result from movement of said sealing means, said bearing bracket including a suction nozzle which is guided through said sealing disc.

10. Apparatus according to claim 1 wherein said duct means is provided with guide profiles for said sealing means with tracks being provided for said bracket means formed by an upper and lower section of said duct means, said bracket means being guided on an endless track through the intermediary of said duct means provided with inlet and outlet sluices.

11. Apparatus according to claim 1 wherein said duct means are provided with tracks for guiding movement of said bracket means relative thereto, said apparatus further comprising drive means for said bracket means and additional guide tracks having said bracket means together with said drive means guided thereon and connected therewith permanently in a positive locking manner.

12. Apparatus according to claim 11 wherein said drive means is equipped with a driving motor, and an undercarriage carrying a friction drive and movable in said additional guide track.

13. Apparatus according to claim 12 wherein said undercarriage is connected with said bracket means by means of a joint element having an essentially vertically aligned joint axis.

14. Apparatus according to claim 12 wherein said undercarriage and said bracket means are supported in said additional guide track by rollers whose suspension with respect to said undercarriage and said bracket means is rotatively constructed.

15. Apparatus according to claim 12 wherein said drive means is an electric motor and said friction drive runs on said additional guide track.

16. Apparatus according to claim 15 wherein said friction drive includes a friction wheel having a profile equipped at its contact area with an approximately symmetrically arranged center apex, a radius of curvature being such that said friction wheel engages with a slightly projecting region of the profile into a motion slot of said guide track.

17. Apparatus according to claim 11 wherein there is provided a joint connecting said bracket means with said drive means in a positive locking manner, said joint including working planes offset in steps with the mass centers of said bracket means on one side and said drive means on the other side being each arranged at different sides of said guide track.

18. Apparatus according to claim 1 wherein said elongate duct means comprise an elongate stationary duct and an elongate movable duct, said apparatus further comprising additional bearing bracket means longitudinally movable along said elongate stationary duct connecting said elongate movable duct with said stationary duct and additional displaceable sealing means on said stationary duct adapted to be moved by said additional bearing bracket means between a position sealing said stationary duct and a position allowing said movable duct to be placed in flow communication with said stationary duct as said additional bearing bracket means is moved along said stationary duct.

19. Apparatus according to claim 18 wherein said bearing bracket means and said displaceable sealing means are provided on said movable duct with said exhaust hose means being connected by said bearing bracket means with said movable duct means.

20. Apparatus according to claims 18 or 19 wherein said elongate movable duct is arranged with its longitudinal dimension extending perpendicularly to the longitudinal dimension of said elongate stationary duct, said movable duct having an end face which is attached directly with said additional bearing bracket means.

21. Apparatus according to claim 18 further comprising drive means for moving said movable duct relative to said stationary duct.

22. Apparatus according to claim 19 further comprising drive means for moving said exhaust hose means and said bearing bracket means relative to said movable duct.

23. Apparatus according to claim 19 wherein said exhaust hose means comprise an effective free end thereof which is adjustable in height.

24. Apparatus according to claim 18 wherein a third suction duct is provided for elevation adjustment adjacent to said stationary duct and said movable duct, and arranged to extend perpendicularly to said stationary duct, said third suction duct being movable in said movable duct and arranged vertically thereto.

25. Apparatus according to claim 18 further comprising control means including a controller operative to synchronize the movements of the elements of said apparatus to enable adjustability thereof within a three-dimensional operating range.

26. Apparatus for removing pollutants, particularly automotive exhaust gases, from work areas or the like comprising elongate stationary duct means for exhausting pollutants therethrough, elongate movable duct means, first bearing bracket means longitudinally movable along said stationary duct means connecting said movable duct means with said stationary duct means, first displaceable sealing means on said stationary duct means adapted to be moved by said first bearing bracket means between a position sealing said stationary duct means and a position allowing said movable duct means to be placed in flow communication with said stationary duct means as said first bearing bracket means is moved along said stationary duct means, exhaust hose means adapted to receive pollutants operatively connected with said movable duct means, second bearing bracket means longitudinally movable along said movable duct means connecting said exhaust hose means with said movable duct means, and second displaceable sealing means on said movable duct adapted to be moved by said second bearing bracket means between a position sealing said movable duct means and a position allowing said exhaust hose means to be placed in flow communication with said movable duct means as said second bearing bracket means is moved along said movable duct means, said first and said second displaceable sealing means comprising sealing elements constructed in the form of link elements connected with each other and movable relative to each other.

* * * * *